US005755289A

United States Patent [19]

Angman et al.

[11] Patent Number: 5,755,289

[45] Date of Patent: May 26, 1998

[54] DRILLING RIG ELEVATOR WITH REPLACEABLE CLAMPING INSERTS AND METHOD FOR INSTALLATION

[75] Inventors: Per G. Angman, Alberta, Canada; Jens Lutzhoft; Hans-Jurgen Ulbrich, both of Hamburg, Germany

[73] Assignee: Tesco Corp, Calgary, Canada

[21] Appl. No.: 640,458

[22] Filed: May 1, 1996

[51] Int. Cl.[6] ..... E21B 19/06

[52] U.S. Cl. ..... 166/378; 166/77.51; 175/202

[58] Field of Search ..... 166/77.1, 77.52, 166/77.53, 378; 175/85, 195, 203; 294/102.2, 90

[56] References Cited

U.S. PATENT DOCUMENTS

| | | | |
|---|---|---|---|
| 4,304,310 | 12/1981 | Garrett | 175/195 |
| 4,450,606 | 5/1984 | Broussard | 175/423 X |
| 4,511,169 | 4/1985 | Willis | 294/116 |
| 4,647,099 | 3/1987 | Berry et al. | 294/103.1 |
| 4,650,236 | 3/1987 | Haney et al. | 294/110.1 |
| 4,791,997 | 12/1988 | Krasnov | 175/57 |
| 4,793,422 | 12/1988 | Krasnov | 175/57 |
| 5,297,833 | 3/1994 | Willis | 294/102.2 |

*Primary Examiner*—Frank Tsay

*Attorney, Agent, or Firm*—Bush, Riddle, & Jackson, L.L.P.

[57] ABSTRACT

An elevator mechanism for use on drilling rigs for hoisting and lowering different sizes and types of pipe. At least two elevator frame sections are interconnected in relative moveable relation for movement between an open position for receiving a section of pipe and a closed position clamping about the pipe. At least two pipe clamping inserts being received in interengaged relation by respective elevator frame sections in a manner resisting upward and downward movement relative to the frame sections. The pipe clamping inserts are mechanically interengaged with the elevator sections to prevent inadvertent disassembly downward and are releaseably locked to secure the inserts against rotation relative to the frame sections. For assembly and disassembly of the inserts relative to the frame sections, the inserts, when unlocked, are rotated for engagement or separation of the mechanically interengaged relation.

14 Claims, 3 Drawing Sheets

FIG. 3
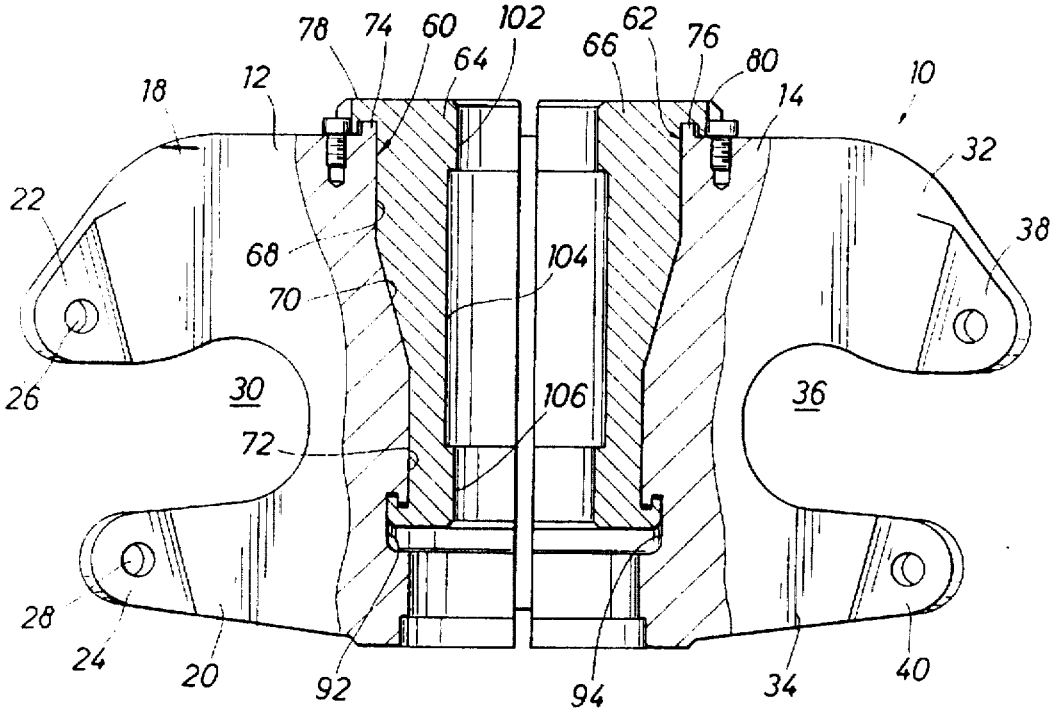
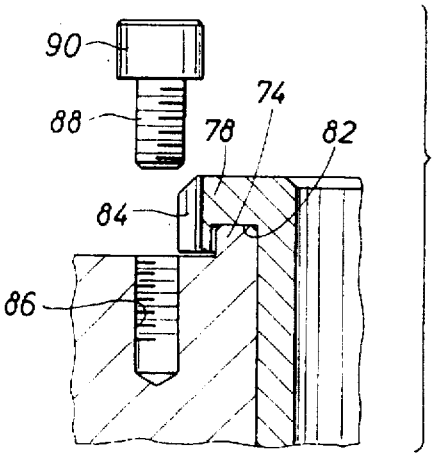
FIG. 4
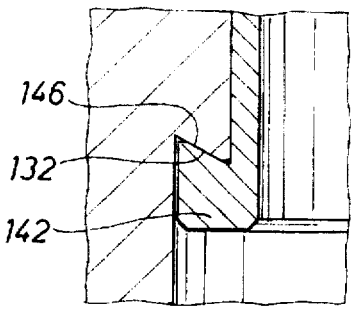
FIG. 7
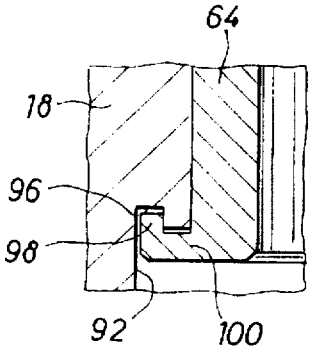
FIG. 5

FIG. 6
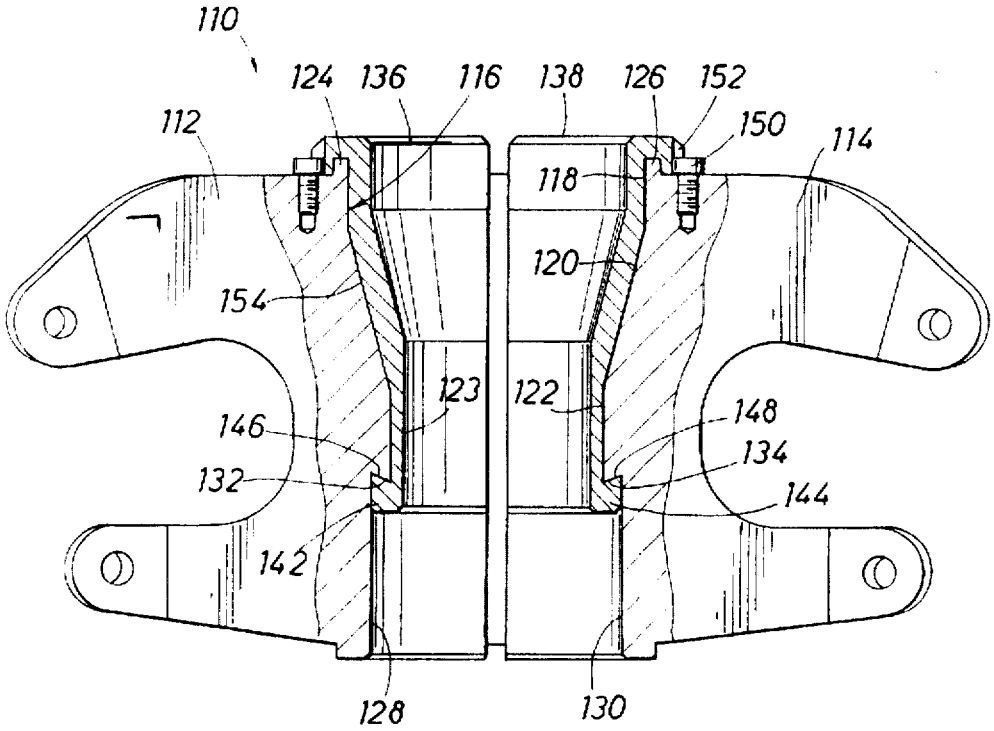
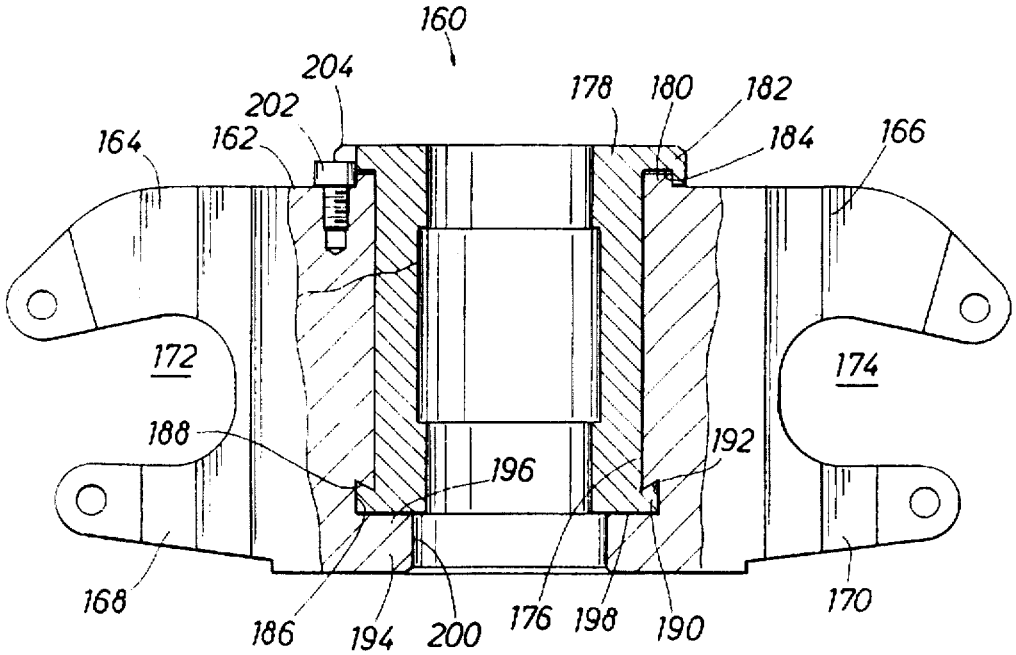
FIG. 8

DRILLING RIG ELEVATOR WITH REPLACEABLE CLAMPING INSERTS AND METHOD FOR INSTALLATION

BACKGROUND OF THE INVENTION

1. Field of the Invention

This invention relates generally to elevator systems that are utilized on well drilling rigs for hoisting and lowering various types of pipe such as drill stem, well casing and well tubing. More specifically, the present invention concerns the provision of a drilling rig elevator assembly having replaceable pipe support inserts that enable a single elevator frame assembly to be selectively adapted for hoisting various types and sizes of pipe during well drilling and completion activities.

2. Description of the Prior Art

In the drilling industry, it is the usual practice to hoist various types of pipe such as drill stem, well casing and well production tubing with various elevators of different capacities. The internal diameters and configurations of the elevators are specifically dressed for precise interfitting relation with the tool joints of the pipes to be handled. Under normal well drilling and completion operations, it is therefore necessary to maintain readily available to the working floor of the drilling rig a wide selection of elevators with different capacities and diameters so that the various types and sizes of pipe and casing may be handled as needed during various phases of the well drilling and completion operations.

As drilling rig elevators are designed for carrying substantial loads, the operating personnel of a drilling rig must carefully select specific elevators that are intended for a particular function or purpose. A wide selection of elevators must therefore typically be maintained in the immediate vicinity of the working floor of the drilling rig and must be periodically changed out in order to provide for the handling the different types and sizes of pipe that are to be used. Obviously, the need for changing out elevators each time there is a change in the type of pipe or casing to be handled becomes a significant expense that detracts from the commercial viability of the drilling operations from the standpoint of both equipment cost and lost productivity. For lowering or hoisting pipe of different sizes, elevators must be exchanged i.e., actual drilling time is reduced by this elevator exchange operation. Accordingly, it is desirable to provide a novel drilling rig elevator assembly having the capability for simple and efficient low cost conversion thereof to permit its selective handling of the various types and sizes of pipe, casing and tubing that are to be handled during well drilling and completion operations.

It is therefore a principal feature of the present invention to provide a novel drilling rig elevator system that may be readily adapted without replacement so that it will receive and efficiently handle all of the types and sizes of pipe and casing that are hoisted and lowered during well drilling and completion operations.

It is another feature of this invention to provide a novel elevator system for drilling rigs wherein a single elevator frame may be employed and wherein elevator inserts may be selectively utilized to adapt the elevator frame for hoisting and lowering any particular size or type of pipe that is to be handled.

It is an even further feature of the present invention to provide a novel elevator system for well drilling operations wherein a moveably joined elevator frame assembly is provided which defines frame sections having internal insert receptacles and wherein various types of pipe clamping inserts are selectively disposed in interlocking and yet easily removable assembly with the respective elevator frame sections to permit simple and efficient replacement of elevator inserts without involving significant capital equipment expense, manual labor costs or drilling rig downtime.

SUMMARY OF THE INVENTION

The various objects and features of the present invention, as set forth above are realized according to the spirit and scope of the invention through the provision of an elevator system having replaceable clamping inserts that selectively adapt the elevator assembly for handling a particular size and type of pipe and which can be simply and efficiently converted by insert interchange to adapt the elevator system for hoisting a different size or type of pipe. There is provided an elevator frame having a pair of frame sections that are pivotally interconnected in conventional manner and are provided with a conventional latch mechanism for securing the elevator frames in the closed positions thereof Internal surfaces of each of the elevator frame sections are machined or otherwise dressed to define internal clamping insert receptacles which are of arcuate configuration and which establish undercut regions or other interlocking receptacle geometry. A pair of clamping inserts are provided for each differing pipe dimension or configuration so that each pair of replaceable inserts will adapt the elevator system to hoist and lower a pipe of particular size and character. Each of the inserts is configured externally for its precise interfitting assembly with the respective elevator frame section. Each of the clamping inserts is also externally configured to define a segment of a circle and defines external interlocking sections in the form of flanges having a configuration corresponding of to the configuration of the respective locking receptacles. These insert segments are installed in interlocked assembly with the respective elevator frame sections by first inserting in portions of the interlocking flanges of the clamping inserts into respective circular insert receptacles or about circular insert retaining projections and by then rotating the insert until it is fully received in interlocking relation with the respective elevator frame section. After the clamping inserts have been so positioned with respect to each elevator frame sections, locking elements such as bolts, cap screws, set screws or the like are then utilized to secure each of the clamping inserts in immovable, i.e. nonrotatable, relation with respect to the frame section with which it is assembled.

When it is desirable to replace the clamping inserts of the elevator frame sections and thereby convert the elevator assembly for handling another type or size of pipe, the locking elements are simply released so as to loosen the inserts with respect to the frame sections. Thereafter, the inserts are simply rotated relative to the respective frame section so that each insert section will slide out of its interlocking relationship with the internal mounting geometry of the frame section. After this has been done, a replacement clamping insert system having two pipe clamping insert sections may be caused to slide into interlocking relationship with the respective frame sections so that, when properly positioned, the replacement inserts are locked in immovable but replaceable assembly with the respective elevator frame sections.

BRIEF DESCRIPTION OF THE DRAWINGS

The various objects and advantages of this invention will become apparent to those skilled in the art upon an understanding of the following detailed description of the invention, read in light of the accompanying drawings which are made a part of this specification and in which:

FIG. 3 is an elevational view of the elevator assembly of FIG. 2 with an internal portion thereof broken away and shown in section and further showing replaceable clamping inserts being secured in interlocked assembly therewith, the clamping inserts being internally profiled for hoisting and lowering of pipe of a particular type and dimension.

FIG. 4 is an exploded fragmentary sectional view of the upper portion of the drilling rig elevator and clamping insert assembly of FIG. 3 for illustrating the manner by which the clamping inserts are secured in immovable relation with respective frame sections.

FIG. 5 is a fragmentary sectional view of a lower portion of the drilling rig elevator and replaceable insert assembly of FIG. 3 and showing an example of the interlocking relationship that is established between the elevator frames and clamping inserts.

FIG. 6 is an elevational view of a drilling rig elevator assembly constructed in accordance with the present invention and having a central portion thereof broken away and shown in section for illustration of an alternative embodiment for interlocking connection of clamping inserts therein, the clamping inserts having a particular internal profile and dimension for hoisting and lowering pipe of a particular type and dimension.

FIG. 7 is a fragmentary sectional view of the drilling rig elevator assembly of FIG. 6 showing an interlocking receptacle and interlocking flange being disposed in interengaging relation.

FIG. 8 is an elevational view of an elevator assembly representing a further alternative embodiment of this invention and showing differing interlocking assembly of a clamping insert therewith, the clamping insert being internally profiled for a particular type and dimension of pipe to be hoisted and lowered by the elevator assembly.

DETAILED DESCRIPTION OF PREFERRED EMBODIMENT

Figure 1:
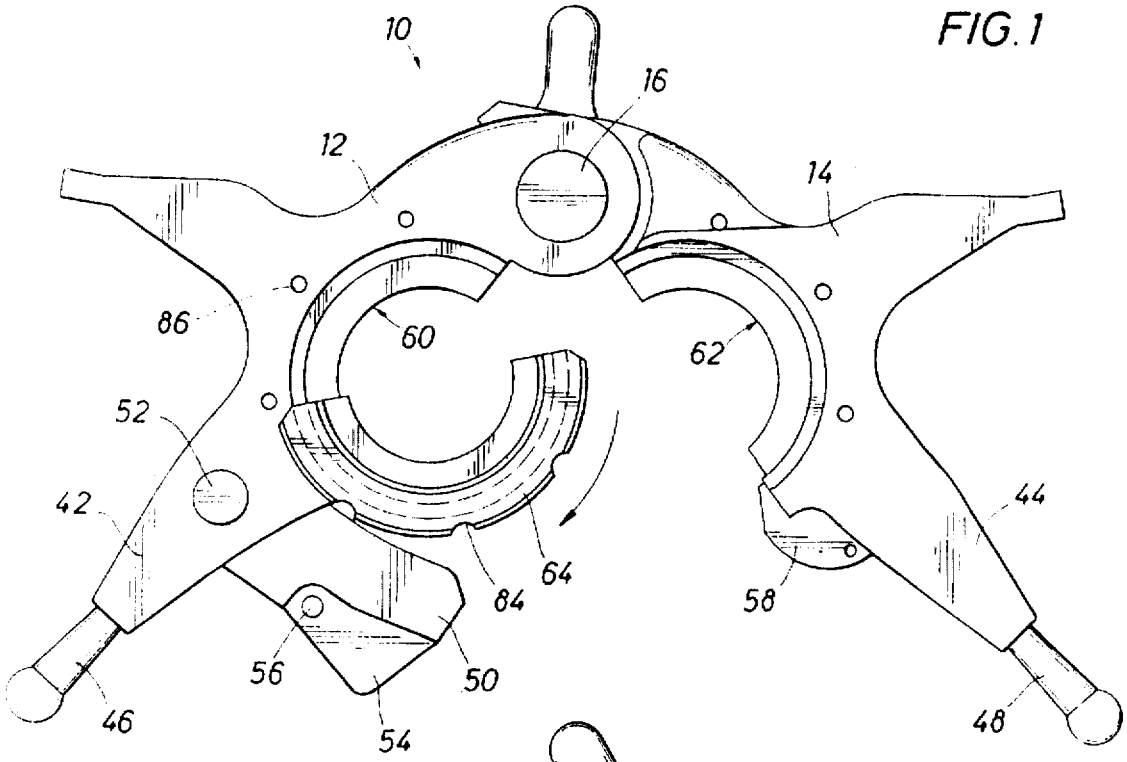
FIG. 1 is a plan view of a drilling rig elevator assembly having a pair of frame sections that are shown pivoted to the open condition thereof and further showing a clamping insert being rotatably moved as shown by a motion arrow for rotatably sliding it into interlocking assembly with its frame section.
Figure 2:
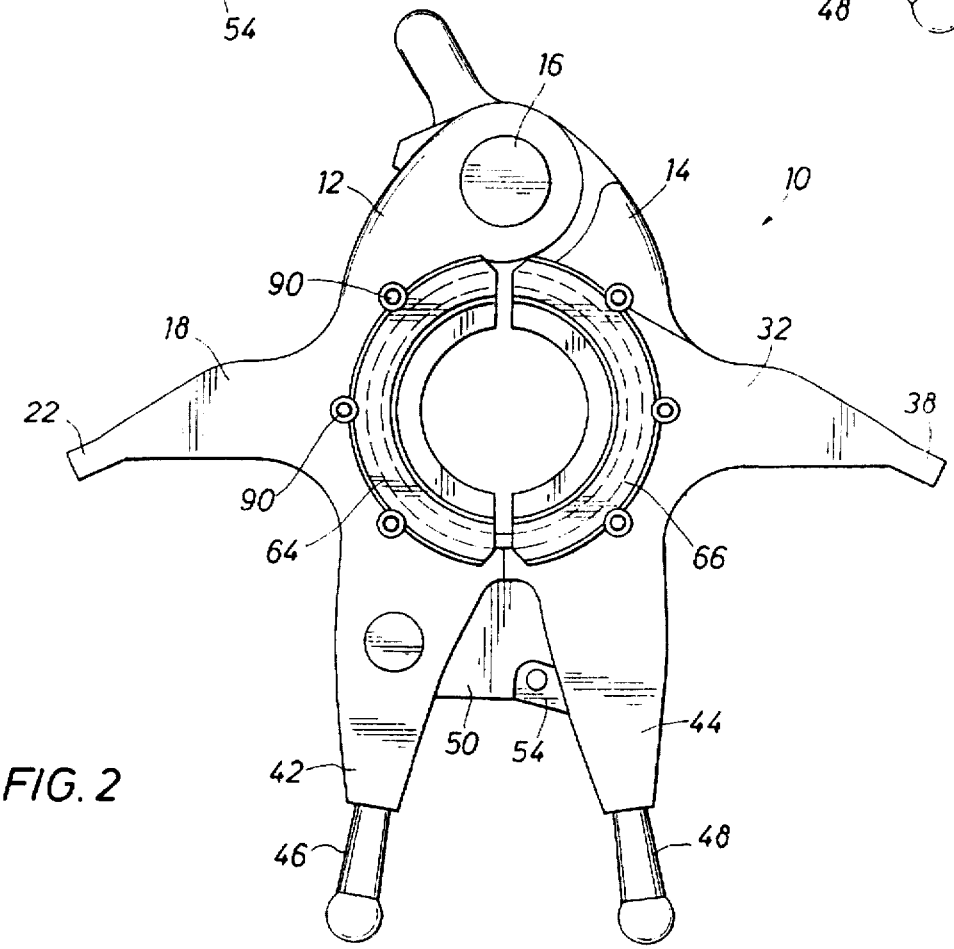
FIG. 2 is an elevational view of the drilling rig elevator assembly of FIG. 1 showing the elevator assembly in its closed and latched condition and with both clamping inserts fully assembled and locked immovably with respect to individual elevator frame sections.

Referring now the drawings and first to FIGS. 1–3, an elevator mechanism for use on drilling rigs for hoisting and lowering various types and sizes of pipe is shown generally at 10 and incorporates a pair of elevator frame sections 12 and 14 that are movably interconnected by means of a pivot assembly 16. As is more evident from FIG. 3, each of the frame sections defines support means that enable the elevator to be supported by the elevator links of a conventional drilling rig hoist mechanism. As shown in FIG. 3, the elevator frame section 12 defines upper and lower vertically spaced arms 18 and 20 that define respective connection flanges 22 and 24. These flanges define apertures 26 and 28 respectively, that receive bolts or other suitable connector elements which secure the upper and lower ends of an elevator retainer element to the frame section in a manner closing the elevator link opening 30 that is defined by the spaced arms 18 and 20. The opposite elevator frame section 14 is also provided with support arms 32 and 34 defining a space 36 therebetween and providing retainer connector flanges 38 and 40 which receive another elevator link retainer, not shown. With the elevator link retainers removed, the lower loops of a pair of elevator links are positioned within the respective openings or receptacles 30 and 36 with portions of the support loops surrounding the respective upper arms 18 and 32 of the elevator frame sections. After this has been done, the elevator link retainers are then assembled to the respective retainer flanges and are secured by bolts or pins or any other suitable connectors to close the outer portions of the openings and secure the elevator links in movably connected and supporting relation with respective elevator frame sections. Although a center latch type elevator mechanism is shown in FIGS. 1–3, it should be understood that this embodiment is only intended to identify the scope of this invention. Other types of elevator mechanisms, such as side door elevators for example, may also be manufactured in accordance with the spirit and scope of the present invention.

In the case of manually operated elevator mechanisms such as shown in FIGS. 1–3, the elevator frames 12 and 14 may be provided with respective actuator arms 42 and 44, each having actuator handles 46 and 48, respectively. The frame sections are also provided with an appropriate latch mechanism so that, when pivoted to the closed position for clamping about pipe to be hoisted or lowered, the elevator mechanism will remain latched until such time as it is controllably unlatched and opened. As shown particularly in FIGS. 1 and 2, elevator frame section 12 is provided with a latch element 50 which is movably connected by a pivot 52 to the actuating arm 42 of the frame section. The latch element 50 is provided with a movable latch and latch release element 54 that is pivotally connected thereto by means of a pivot 56. The opposite frame section 14 is also provided with a latch element 58 which, when the elevator frames are closed about a pipe, will be received in interengaging locked relation with respect to latch 50, to thereby secure the elevator frames in the closed position about the pipe. When it is desired to release the pipe, the latch mechanism may be manually actuated to unlatch, after which the actuator arms 42 and 44 may be pivoted apart thereby moving the frames about the pivot 16 from the closed position shown in FIG. 2 to the open position shown in FIG. 1. The basic elevator frame structure described above is of conventional nature. As is typically the case, each of the elevator frame sections will be dressed to receive pipe of a particular size and geometry. Thus, if pipe of a different size or geometry is to be hoisted and lowered by the elevator mechanism, the elevator links must be disconnected from the elevator assembly and another elevator assembly must be interchanged with it so as to adapt the hoisting system of the drilling rig for suitably hoisting and lowering that particular type of pipe. Thus, if the drilling rig is intended to hoist and lower 2, 3 or 4 different types of pipe, for example, drill pipe, well casing, well tubing, etc., then 2, 3 or 4 different types of elevators must be readily available at all times so that they may be changed out and used as needed. When a pipe change is necessary, the drilling rig will experience downtime of the hoisting apparatus sufficiently to disconnect the elevator links from the elevator mechanism being used and reconnect them to another elevator. Thus, elevator downtime adds significantly to the overall costs of the drilling operation. Further, the need for maintaining several elevator assemblies immediately available to the drilling rig floor results in a considerable capital expense which adversely effects the cost of the drilling operation. Therefore, it is desirable to provide a pipe hoisting elevator mechanism that may be simply and efficiently converted from one type of pipe to another to thereby minimize capital expense of the drilling equipment and to also minimize drilling rig downtime that ordinarily occurs during elevator interchange.

According to the principles of the present invention, the various objects and features identified hereinabove are realized through the provision of an elevator mechanism for drilling rigs that is adapted for receiving various types of elevator inserts that quickly and efficiently adapt an elevator assembly for hoisting and lowering a particular type or size of pipe. As shown in FIGS. 1–3, the elevator frame sections 12 and 14 are each provided with essentially semi-circular or arcuate insert receptacles shown generally at 60 and 62. These receptacles are adapted to receive generally arcuate insert segments 64 and 66 which are each appropriately internally dressed for establishing precise interfitting relation with the geometric configuration of the type and size of pipe to be hoisted and lowered.

In the preferred embodiment as shown in FIG. 3, the insert receptacles 60 and 62 are internally dressed to the geometric configuration shown. The internal wall surface of each receptacle segment defines a generally cylindrical upper portion 68, a frusto-conical intermediate section 70 and a generally cylindrical lower section 72. To provide for interengaging support and retention of the insert segments 64 and 66, the respective elevator frame sections 12 and 14 define upwardly projecting retainer flanges 74 and 76, one of which being shown in greater detail in FIG. 4. In corresponding fashion, the upper ends of the inserts 64 and 66 define respective retainer flanges 78 and 80 that are machined to define undercut retainer grooves such as shown at 82 in FIG. 4. When the insert segments are properly seated with respect to the frame sections, the upwardly projecting retainer flange sections or rims will be received within the undercut grooves in the manner shown in FIG. 4. After this interengaging relationship has been established, it is then desirable to lock the insert segments in immovable relation with respect to frame sections. This is accomplished by providing the upper flanges 78 and 80 of the insert segments with peripheral locking recesses such as shown at 84 in FIG. 4 and by drilling and tapping holes in the frame sections as shown at 86. Cap screws 88 are then threaded into the holes, with the respective heads 90 of the cap screws located within the peripheral locking recesses 84. With the cap screws so positioned, the respective insert segments cannot be rotated relative to the respective frame members and therefore the pipe clamping inserts will remain in interlocked assembly with the frame sections and within the respective insert receptacles.

The lower internal portions of each of the frame sections 12 and 14 will be machined to define undercut grooves 92 and 94, a portion of internal locking groove 92 being shown in the enlarged fragmentary sectional view of FIG. 5. The circular locking grooves 92 and 94 define circular undercut groove segments such as shown at 96 in FIG. 5, within which are received hook-like retainer segments 98 projecting upwardly from a retainer flange 100 that extends radially outwardly from the lower end of each of the insert segments. Thus, with the inserts in assembly with the respective frame sections as shown in FIGS. 3, 4 and 5, the inserts are locked against both downward and upward separating movement. They can only move to the extent permitted by the tolerances of the respective upper and lower locking flange engagement of the inserts with respect to the internal receptacles of the frame sections. Such tolerances of the inserts are provided such that the insert is loose enough to slide in the elevator but tight enough so as not to slip out of the elevator. Finally, the insert segments are dressed internally by internal surface segments 102, 104, and 106 that are of a configuration and dimension to receive a pipe collar in close fitting, clamping relation therebetween when the elevator mechanism is closed as shown in FIG. 2.

An alternative embodiment of the present invention is shown generally at 110 in FIGS. 6 and 7 and incorporates elevator frame sections 112 and 114 that externally are of the same purpose and configuration as discussed above in connection with FIGS. 1–3. These frame sections cooperate to define an internal locking receptacle shown generally at 116 having internal surface segments 118, 120 and 122 essentially corresponding to the internal receptacle configuration 60 that is shown in FIG. 3 and defined by surface segments 68, 70 and 72.

The upper portions of the frame sections define upwardly projecting circular locking segments 124 and 126 which are of the same structure and function as shown at 74 and 76 in FIG. 3. Within the lower portions of the each of frame sections, the respective locking receptacles define internal cylindrical surfaces 128 and 130 that intersect with respective internal cylindrical surfaces 122 and 123 by means of upwardly and outwardly inclined surface segments 132 and 134. These surface segments in essence define an undercut insert locking shoulder. The respective replaceable inserts 136 and 138 each define an upper geometry of the same configuration and function as described above in connection with FIGS. 1–3. At the lower portions thereof, the inserts define outwardly projecting shoulder sections 142 and 144 having upwardly directed inclined shoulders 146 and 148 that correspond with the configuration of the undercut inclined shoulder surfaces 132 and 134. The manner by which the inserts 136 and 138 are assembled to their respective frame sections is by rotatable interconnection such as shown by the movement arrow in FIG. 1. The inserts are simply rotated within the insert receptacles of the frame sections to slide the respective retainer flanges in interengaging relation with the retainer grooves of the elevator sections until their respective locking recesses are in alinement with the threaded holes, such as is shown at 86 in FIG. 1. Thereafter, cap screws 150 are threaded into the locking openings of the frame sections so that the heads thereof are received in locking relation within the respective peripheral recesses 152 of the upper locking flange of each of the inserts.

Typically, the force that is applied to the inserts by pipe is a downwardly directed force which is resisted by the internal shoulder 120 of the insert receptacle which provides support for the external tapered shoulder 154 of the inserts. In the event an upwardly directed force is applied to the insert segments, the lower peripheral flange or shoulder 142 and 144 of the insert segments will secure the insert segments against upward movement. Obviously, in the case of drilling rig hoist apparatus, the downwardly directed force that must be accommodated by the elevator system will significantly exceed any upwardly directed force that it will experience.

A further alternative embodiment of the present invention is shown generally at 160 which is in the form of a side door type drilling rig elevator having a single frame section 162 defining elevator link support arms 164 and 166 and lower elevator retainer arms 168 and 170 that are disposed in spaced relation with the respective elevator support arms and define elevator link receptacles 172 and 174. These receptacles are closed by appropriate retaining elements that are secured thereto by pins or bolts that extend through the respective apertures thereof in the manner described above. The elevator frame 162 will be provided with a pivotally mounted side door type elevator door segment which provides closure for the elevator about a pipe section when the elevator door segment is closed and latched. The elevator frame 162 further defines an internal insert receptacle 176 which is adapted to receive a pipe support insert 178 in mechanically interengaged and locked relation therein. The upper portion of the frame segment 162 defines an upwardly projecting arcuate retainer rim 180 which is of essentially the same configuration and purpose as is discussed above at 124–126 in FIG. 6, for receiving the upper externally flanged end 182 of the insert segment. The undercut receptacle 184 that receives the retainer rim is of corresponding arcuate configuration so as to permit interlocking engagement of the upper portion of the frame and insert by moving the arcuate insert in rotary fashion as is shown by the movement arrow in FIG. 1 until the insert segment has been received in fully engaged and properly positioned relation with its frame section. Also for interlocking interengagement of the lower portion of the insert within the insert receptacle of the elevator frame, the elevator frame is internally machined to define a semi-dovetail groove 186 of arcuate configuration and having an upper upwardly and outwardly inclined frusto-conical surface 188 which defines a downwardly facing support shoulder. Correspondingly, the lower end of the pipe support insert segment 178 is provided with an external locking flange 190 having an upwardly facing frusto-conical surface 192 which prevents upward movement of the insert segment relative of the internal insert receptacle of the elevator frame section. For supporting the insert segment within its receptacle when significant downward load is applied thereto, the frame section defines an internally projecting bottom flange 194 of significant structural integrity which defines an upwardly facing internal shoulder 196 which is disposed for supporting engagement with the downwardly facing lower end 198 of the insert segment. The large circular surface dimension of the shoulder surface 196 provides for even distribution of load from the pipe support insert to the elevator frame. The bottom flange also defines a cylindrical surface 200 defining the central pipe transit opening of the elevator frame.

For assembly of the insert segment 178 to the frame section an arcuate end of the insert is positioned so that the flanges 182 and 190 are oriented as shown in FIG. 8 with respect to the arcuate rim 180 and the arcuate retainer groove. Thereafter the insert is simply rotated until its interlocking flange is fully interengaged within the corresponding locking groove of its receptacle. The insert segment is then locked in place by cap screw type retainers 202 that are received within peripheral locking recesses 204 of the insert flange 182.

In view of the foregoing, it is evident that the present invention is one well adapted to attain all the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A method for connecting replaceable pipe clamping inserts in pipe supporting assembly with a drilling rig elevator mechanism, having elevator frame sections defining insert receptacles and having replaceable pipe clamping inserts defining an external geometry for mechanically engaged relation with respective elevator frame sections, said insert receptacles defining at least one arcuate internal groove and said pipe clamping inserts defining at least one arcuate external locking flange; said method comprising:

(a) moving said pipe clamping inserts into mechanically engaged relation within said insert receptacles so as to support said pipe clamping inserts against axial movement thereof in at least one axial direction;

(b) locking said pipe clamping inserts against disassembly from said mechanically engaged relation; and (c) moving said pipe clamping inserts relative to said elevator frame sections such that a mechanically engaged relation is established between said arcuate internal groove and said arcuate external locking flange for securing said pipe clamping inserts against said axial movement relative to said elevator frame sections.

2. An elevator mechanism for use on drilling rigs for hoisting and lowering pipe, comprising:

(a) at least two elevator frame sections being interconnected in relative moveable relation for movement between an open position to permit assembly thereof about a section of pipe and a closed position clamping about a section of pipe in preparation for hoisting and lowering thereof; said elevator frame sections defining insert receptacles having arcuate groove means;

(b) at least two pipe clamping inserts being received in said insert receptacles in interengaged relation by respective elevator frame sections and secured by said interengaged relation against upward and downward axial movement relative to said elevator frame sections; said inserts defining arcuate flange means engageable within said arcuate groove means, said arcuate flange means supporting said inserts against axial movement relative to said elevator frame sections;

(c) means securing said pipe clamping inserts in mechanically interengaged relation with respective elevator frame sections and securing said clamping inserts against upward and downward axial movement relative to said elevator frame sections; and (d) means releasably locking said pipe clamping inserts in assembly with said elevator frame sections.

3. The elevator mechanism of claim 2, wherein:

(a) said arcuate groove means defining a downwardly facing undercut shoulder; and (b) said arcuate flange means having an upwardly facing geometry corresponding to the configuration of said undercut shoulder and being disposed for upward force resisting engagement therewith.

4. The elevator mechanism of claim 3, wherein:

said arcuate groove means and said arcuate flange means being of hook-like cross-sectional configuration.

5. The elevator mechanism of claim 2, wherein:

(a) said elevator frame sections each defining arcuate rims; and (b) said pipe clamping inserts defining arcuate retainer means overlying said arcuate rims and restraining downward axial movement of said pipe clamping inserts relative to said elevator frame sections.

6. The elevator mechanism of claim 5, wherein:

(a) said arcuate rims projecting upwardly from respective elevator frame sections; and (b) said arcuate retainer means being outer peripheral flanges of said pipe clamping inserts, said outer peripheral flanges defining downwardly facing grooves receiving said arcuate rims therein.

7. An elevator mechanism for use on drilling rigs for hoisting and lowering pipe, comprising:

(a) at least two elevator frame sections being interconnected in relative moveable relation for movement between an open position to permit assembly thereof about a section of pipe and a closed position clamping about a section of pipe in preparation for hoisting and lowering thereof;

(b) at least two pipe clamping inserts being retained in releasable assembly by respective elevator frame sections and being of a configuration for interfitting relation with a particular size and type of pipe;

(c) said elevator frame sections each defining an insert receptacle having internal arcuate groove means; and (d) arcuate flange means being defined by said inserts and being engageable within said arcuate groove means of respective insert receptacles, said arcuate flange means supporting said inserts against axial movement relative to said elevator frame sections.

8. The elevator mechanism of claim 7, wherein:

(a) said arcuate groove means defining a downwardly facing undercut shoulder; and (b) said arcuate flange means having an upwardly facing geometry corresponding to the configuration of said undercut shoulder and being disposed for upward force resisting engagement therewith.

9. The elevator mechanism of claim 7, wherein:

said arcuate groove means and said arcuate flange means being of hook-like cross-sectional configuration.

10. A method for connecting replaceable pipe clamping inserts in pipe supporting assembly with a drilling rig elevator mechanism, having elevator frame sections defining insert receptacles and having replaceable pipe clamping inserts defining an external geometry for mechanically engaged relation with respective elevator frame sections, said insert receptacles defining at least one arcuate internal groove and at least one arcuate rim, and said clamping inserts defining arcuate ends, at least one arcuate external locking flange, and at least one arcuate rim receptacle; said method comprising:

(a) moving said pipe clamping inserts into mechanically engaged relation within said insert receptacles so as to support said pipe clamping inserts against axial movement thereof in at least one axial direction;

(b) locking said pipe clamping inserts against disassembly from said mechanically engaged relation; and rotating each of said pipe clamping inserts into mechanically engaged relation with its respective insert receptacle until said arcuate external locking flange is disposed in fully engaged relation within said arcuate internal groove and said arcuate rim receptacle is disposed in fully engaged relation about said arcuate rim and said pipe clamping inserts are in axially restrained relation with said elevator frame sections in both upward and downward axial directions.

11. A method for connecting replaceable pipe clamping inserts in pipe supporting assembly with a drilling rig elevator mechanism, having elevator frame sections defining insert receptacles and having replaceable pipe clamping inserts defining an external geometry for mechanically engaged relation with respective elevator frame sections; comprising:

(a) moving said pipe clamping inserts into mechanically engaged relation within said insert receptacles so as to support said pipe clamping inserts against axial movement thereof in at least one axial direction; said pipe clamping inserts defining at least one external locking receptacle;

(b) locking said pipe clamping inserts against disassembly from said mechanically engaged relation; and (c) securing locking means to said elevator frame sections and in rotation restraining engagement within said external locking receptacle.

12. An elevator mechanism for use on drilling rigs for hoisting and lowering pipe, comprising:

(a) at least two elevator frame sections being interconnected in relative moveable relation for movement between an open position to permit assembly thereof about a section of pipe and a closed position clamping about a section of pipe in preparation for hoisting and lowering thereof; said elevator frame sections defining insert receptacles;

(b) at least two pipe clamping inserts being received in said insert receptacles in interengaged relation by respective elevator frame sections and secured by said interengaged relation against upward and downward axial movement relative to said elevator frame sections;

(c) means securing said pipe clamping inserts in mechanically interengaged relation with respective elevator frame sections and securing said clamping inserts against upward and downward movement relative to said elevator frame sections;

(d) means releasably locking said pipe clamping inserts in assembly with said elevator frame sections;

(e) lock receiver means defined by said elevator frame sections;

(f) lock receptacle means defined by each of said pipe clamping inserts; and (g) lock elements received in secured relation with said lock receiver means and establishing engaged relation with said lock receptacle means so as to secure said pipe clamping inserts against rotational movement relative to said elevator frame sections.

13. The elevator mechanism of claim 12 wherein:

(a) said pipe clamping inserts each defining an outwardly projecting upper flange defining at least one lock receptacle recess opening externally thereof; and (b) said lock elements being screws received by said frame sections and engaging within said lock receptacle means.

14. An elevator mechanism for use on drilling rigs for hoisting and lowering pipe, comprising:

(a) at least two elevator frame sections being interconnected in relative moveable relation for movement between an open position to permit assembly thereof about a section of pipe and a closed position clamping about a section of pipe in preparation for hoisting and lowering thereof;

(b) at least two pipe clamping inserts being retained in releasable assembly by respective elevator frame sections and being of a configuration for interfitting relation with a particular size and type of pipe, (c) said elevator frame sections each defining arcuate rims projecting upwardly from respective elevator frame sections; and (d) said pipe clamping inserts defining arcuate retainer means overlying said arcuate rims and defining downwardly facing arcuate grooves receiving said arcuate rims therein and restraining downward axial movement of said pipe clamping inserts relative to said elevator frame sections.

* * * * *